US010490136B2

(12) United States Patent
Zhu et al.

(10) Patent No.: US 10,490,136 B2
(45) Date of Patent: Nov. 26, 2019

(54) PIXEL CIRCUIT AND DISPLAY DEVICE

(71) Applicant: SHANGHAI TIANMA AM-OLED CO., LTD., Shanghai (CN)

(72) Inventors: Renyuan Zhu, Shanghai (CN); Yue Li, Shanghai (CN); Dongxu Xiang, Shanghai (CN); Yana Gao, Shanghai (CN); Xingyao Zhou, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 16/203,645

(22) Filed: Nov. 29, 2018

(65) Prior Publication Data

US 2019/0096337 A1 Mar. 28, 2019

(30) Foreign Application Priority Data

Apr. 26, 2018 (CN) ..... 2018 1 0385565

(51) Int. Cl.
*G09G 3/3291* (2016.01)
*G09G 3/3233* (2016.01)
*G09G 3/3258* (2016.01)

(52) U.S. Cl.
CPC ..... *G09G 3/3291* (2013.01); *G09G 3/3233* (2013.01); *G09G 3/3258* (2013.01); *G09G 2300/043* (2013.01); *G09G 2300/0426* (2013.01); *G09G 2300/0439* (2013.01)

(58) Field of Classification Search
CPC .. G09G 3/3291; G09G 3/3258; G09G 3/3233; G09G 2300/0426; G09G 2300/0819; G09G 2300/0842; G09G 2310/0262; G09G 3/3225; G09G 2310/08; G09G 2300/0852; G09G 2300/043; G09G 2300/0439; G09G 2310/0245
See application file for complete search history.

(56) References Cited

U.S. PATENT DOCUMENTS 10,388,214 B2 * 8/2019 Na
2017/0076671 A1 * 3/2017 Kim ..... G09G 3/3233
2018/0006099 A1 * 1/2018 Ka ..... H01L 27/1222
2018/0025683 A1 * 1/2018 Oh ..... G09G 3/2018 345/690

FOREIGN PATENT DOCUMENTS

CN 104200771 A 12/2014

* cited by examiner

*Primary Examiner* — Muhammad N Edun
(74) *Attorney, Agent, or Firm* — Kilpatrick Townsend & Stockton, LLP

(57) ABSTRACT

A pixel circuit and a display device are provided. The pixel circuit includes a first transistor, a second transistor, a third transistor, a fourth transistor, a fifth transistor, a sixth transistor, a driving transistor, a first capacitor and a second capacitor. A threshold voltage of the driving transistor is compensated through a cooperation of the transistors and the capacitors in a source following manner, such that a driving current generated by the driving transistor for driving a light emitting element to emit light is independent from the threshold voltage of the driving transistor itself. In addition, the driving transistor and the anode of the light emitting element are reset through the cooperation of the transistors, thereby avoiding from grabbing a different threshold voltage after a gray scale transition, thus avoiding afterimages and insufficient brightness of the first frame after the gray scale transition.

11 Claims, 9 Drawing Sheets

PIXEL CIRCUIT AND DISPLAY DEVICE

The present application claims priority to Chinese Patent Application No. 201810385565.4, titled "PIXEL CIRCUIT AND DISPLAY DEVICE", filed on Apr. 26, 2018 with the Chinese Patent Office, which is incorporated herein by reference in its entirety.

FIELD

The present disclosure relates to the field of organic light emitting display technology, and in particular to a pixel circuit and a display device.

BACKGROUND

With the continuous development of multimedia, the organic light emitting diode (OLED) display attracts great attention in the display market owing to its advantages such as a simple structure, an excellent operating temperature, a good contrast and a good view angle. The OLED displays are classified into passive matrix OLED displays and active matrix OLED displays. The active matrix OLED display is widely used because of its low power consumption. Reference is made to FIG. 1, which is a circuit diagram of a conventional pixel circuit in an organic light emitting diode display. The conventional pixel circuit has a 3T1C structure, that is, the conventional pixel circuit includes three P-type transistors and one capacitor. When the conventional pixel circuit operates, the transistor T3 transmits a reset voltage Vinit to an anode of the light emitting diode OLED under the control of a control signal S1, to reset the anode of the light emitting diode OLED. Then, the transistor T1 is turned on under the control of a signal supplied by a scan line, and a data voltage Vdata is supplied by a data line connected to the transistor T1. The data voltage Vdata is stored in the capacitor C, to ensuring the stability of the current to the light emitting diode OLED in one cycle. The transistor T2, which serves as a current driving transistor, is used to provide a current for the light emitting diode OLED to emit light.

However, since a threshold voltage of one transistor for driving the light emitting diode to emit light in a pixel circuit of a display device is different from that of transistors in other pixel circuits of the same display device depending on a manufacturing process, the light emitting diodes in the multiple pixel circuits may have different currents flowing therethrough when the multiple pixel circuits are supplied with the same data voltage, resulting in uneven light emission of the display device.

SUMMARY

In view of the above, a pixel circuit and a display device are provided according to the present disclosure, to solve the influence of a threshold voltage of a driving transistor on a driving current.

A pixel circuit for driving a light emitting element is provided according to the present disclosure, which includes a first transistor, a second transistor, a third transistor, a fourth transistor, a fifth transistor, a sixth transistor, a driving transistor, a first capacitor and a second capacitor.

A gate of the first transistor is supplied with a first driving signal, a first electrode of the first transistor is supplied with an anode voltage, and a second electrode of the first transistor is connected to a source of the driving transistor.

A gate of the second transistor is supplied with a second driving signal, a first electrode of the second transistor is supplied with a data voltage, and a second electrode of the second transistor is connected to the source of the driving transistor.

A gate of the third transistor is supplied with a third driving signal, a first electrode of the third transistor is connected to a second plate of the first capacitor, a second electrode of the third transistor is connected to a second plate of the second capacitor and a gate of the driving transistor, and a first plate of the first capacitor is supplied with a high level voltage.

A gate of the fourth transistor is supplied with a fourth driving signal, a first electrode of the fourth transistor is connected to the source of the driving transistor, and a second electrode of the fourth transistor is connected to a first plate of the second capacitor.

A gate of the fifth transistor is supplied with a fifth driving signal, a first electrode of the fifth transistor is supplied with a first low level voltage, and a second electrode of the fifth transistor is connected to the second plate of the second capacitor and the gate of the driving transistor.

A gate of the sixth transistor is supplied with a sixth driving signal, a first electrode of the sixth transistor is supplied with a second low level voltage, a second electrode of the sixth transistor is connected to a drain of the driving transistor and an anode of the light emitting element, and a cathode of the light emitting element is supplied with a cathode voltage.

A display device is further provided according to the present disclosure, which includes the above-described pixel circuit.

A pixel circuit and a display device are provided according to the present disclosure. The pixel circuit includes a first transistor, a second transistor, a third transistor, a fourth transistor, a fifth transistor, a sixth transistor, a driving transistor, a first capacitor and a second capacitor. A threshold voltage of the driving transistor is compensated through a cooperation of the transistors and the capacitors in a source following manner, such that a driving current generated by the driving transistor for driving a light emitting element to emit light is independent from the threshold voltage of the driving transistor itself, thereby compensating for a threshold drift caused by a process problem and eliminating uneven light emission of the display device, thus improving the uniformity of the light emission of the display device. In addition, the driving transistor and the anode of the light emitting element are reset through the cooperation of the transistors, thereby avoiding from grabbing a different threshold voltage after a gray scale transition, thus avoiding afterimages and insufficient brightness of the first frame after the gray scale transition.

BRIEF DESCRIPTION OF THE DRAWINGS

The drawings to be used in the description of the embodiments are described briefly as follows. It is apparent that the drawings in the following description only illustrate some embodiments of the present disclosure.

DETAILED DESCRIPTION

Embodiments of the present disclosure are described clearly and completely in conjunction with the accompanying drawings in the embodiments of the present disclosure hereinafter. It is apparent that the described embodiments are merely some rather than all of embodiments of the present disclosure.

As described in the background part, since a threshold voltage of one transistor for driving the light emitting diode to emit light in a pixel circuit of a display device is different from that of transistors in other pixel circuits of the same display device depending on a manufacturing process, the light emitting diodes in the multiple pixel circuits may have different currents flowing therethrough when the multiple pixel circuits are supplied with the same data voltage, resulting in uneven light emission of the display device.

Based on the above, a pixel circuit and a display device are provided according to the embodiments of the present disclosure, to eliminate an influence of a threshold voltage of a driving transistor on a driving current. The embodiments of the present disclosure, which are described in detail in conjunction with FIG. 2 to FIG. 10.

Embodiment 1

Figure 1:
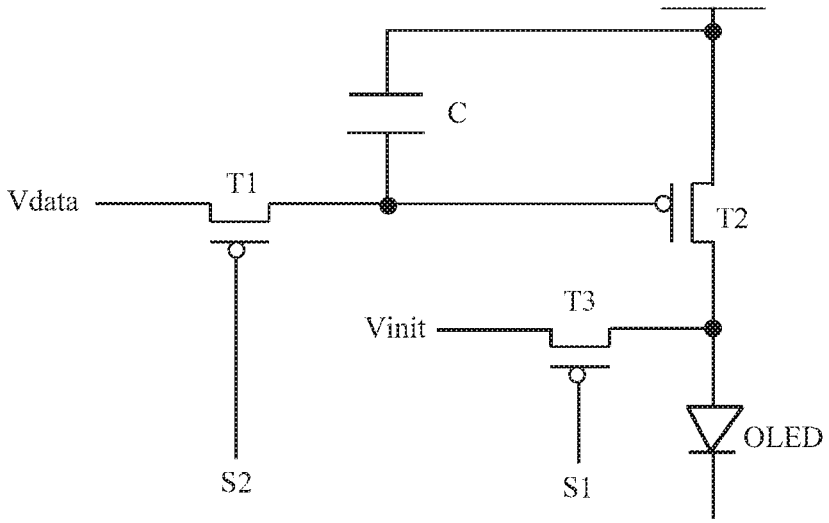
Figure 1 (PRIOR ART)
FIG. 1 is a schematic structural diagram of a pixel circuit according to the conventional technology.
Figure 2:
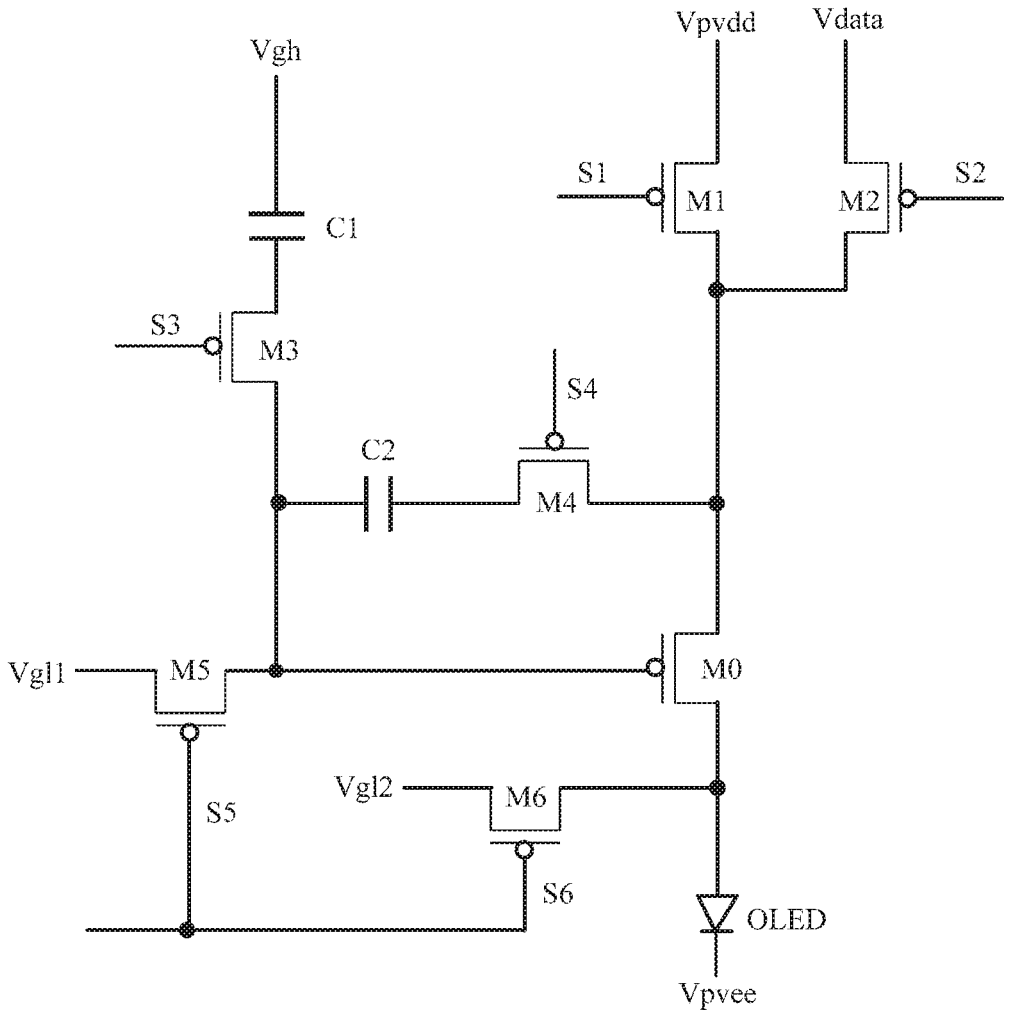
FIG. 2 is a schematic structural diagram of a pixel circuit according to Embodiment 1 of the present disclosure.

A pixel circuit according to Embodiment 1 of the present disclosure is described in detail in conjunction with FIG. 2 to FIG. 7. Reference is made to FIG. 2, which is a schematic structural diagram of a pixel circuit according to Embodiment 1 of the present disclosure. The pixel circuit is used for driving a light emitting element OLED, the light emitting element OLED is a light emitting diode. The pixel circuit includes a first transistor M1, a second transistor M2, a third transistor M3, a fourth transistor M4, a fifth transistor M5, a sixth transistor M6, a driving transistor M0, a first capacitor C1 and a second capacitor C2.

A gate of the first transistor M1 is supplied with a first driving signal S1, a first electrode of the first transistor M1 is supplied with an anode voltage Vpvdd, and a second electrode of the first transistor M1 is connected to a source of the driving transistor M0.

A gate of the second transistor M2 is supplied with a second driving signal S2, a first electrode of the second transistor M2 is supplied with a data voltage Vdata, and a second electrode of the second transistor M2 is connected to the source of the driving transistor M0.

A gate of the third transistor M3 is supplied with a third driving signal S3, a first electrode of the third transistor M3 is connected to a second plate of the first capacitor C1, a second electrode of the third transistor M3 is connected to a second plate of the second capacitor C2 and a gate of the driving transistor M0, and a first plate of the first capacitor C1 is supplied with a high level voltage Vgh.

A gate of the fourth transistor M4 is supplied with a fourth driving signal S4, a first electrode of the fourth transistor M4 is connected to the source of the driving transistor M0, and a second electrode of the fourth transistor M4 is connected to a first plate of the second capacitor C2.

A gate of the fifth transistor M5 is supplied with a fifth driving signal S5, a first electrode of the fifth transistor M5 is supplied with a first low level voltage Vgl1, and a second electrode of the fifth transistor M5 is connected to the second plate of the second capacitor C2 and the gate of the driving transistor M0.

A gate of the sixth transistor M6 is supplied with a sixth driving signal S6, a first electrode of the sixth transistor M6 is supplied with a second low level voltage Vgl2, a second electrode of the sixth transistor M6 is connected to a drain of the driving transistor M0 and an anode of the light emitting element OLED, and a cathode of the light emitting element is supplied with a cathode voltage Vpvee.

According to the embodiment of the present disclosure, the first capacitor C1 is mainly used for voltage maintaining after the third transistor M3 is turned on. The second capacitor C2 is mainly used for voltage coupling after the fourth transistor M4 is turned on. The first capacitor C1 and the second capacitor C2 are connected with each other in parallel and are independent from each other, such that the pixel circuit operates more stably.

According to the embodiment of the present disclosure, it is required to simultaneously turn on or simultaneously turn off the first transistor M1 and the third transistor M3 during a driving process of the pixel circuit. Therefore, in the embodiment of the present disclosure, an effective level of the first driving signal S1 and an effective level of the third driving signal S3 have the same time sequence. The effective level refers to a level for controlling a transistor to be turned on. By setting the effective level of the first driving signal S1 and the effective level of the third driving signal S3 to have the same time sequence, it is possible to control the first transistor M1 and third transistor M3 to be simultaneously turned on, and it is also possible to control the first transistor M1 and the third transistor M3 to be simultaneously turned off in a case of an ineffective level, to achieve the driving requirement that it is required to simultaneously turn on or simultaneously turn off the first transistor M1 and the third transistor M3 during the driving process of the pixel circuit.

According to the embodiment of the present disclosure, the first transistor M1 and the third transistor M3 may have the same turned-on condition or different turned-on conditions. In the embodiment of the present disclosure, in a case that the first transistor M1 and the third transistor M3 have the same turned-on condition, the first driving signal S1 is the same as the third driving signal S3. The first driving signal S1 and the third driving signal S3 may be supplied from different voltage terminals via different wires. In one embodiment, the first driving signal S1 and third driving signal S3 may be supplied from the same voltage terminal via the same wire, thereby saving wiring ports and facilitating circuit wiring.

According to the embodiment of the present disclosure, the fifth transistor M5 and the sixth transistor M6 may also be configured to be simultaneously turned on or simultaneously turned off during the driving process of the pixel circuit. Therefore, in the embodiment of the present disclosure, an effective level of the fifth driving signal S5 and an effective level of the sixth driving signal S6 have the same time sequence. The effective level refers to a level for controlling a transistor to be turned on. By setting the effective level of the fifth driving signal S5 and the effective level of the sixth driving signal S6 to have the same time sequence, it is possible to control the fifth transistor M5 and the sixth transistor M6 to be simultaneously turned on, and it is also possible to control the fifth transistor M5 and the sixth transistor M6 to be simultaneously turned off in a case of an ineffective level, to achieve the driving requirement that it is required to simultaneously turn on or simultaneously turn off the fifth transistor M5 and the sixth transistor M6 during the driving process of the pixel circuit.

According to the embodiment of the present disclosure, the fifth transistor M5 and the sixth transistor M6 may have the same turned-on condition or different turned-on conditions. In the embodiment of the present disclosure, in a case that the fifth transistor M5 and the sixth transistor M6 have the same turned-on condition, the fifth driving signal S5 is the same as the sixth driving signal S6. The fifth driving signal S5 and the sixth driving signal S6 may be supplied from different voltage terminals via different wires. In one embodiment, the fifth driving signal S5 and the sixth driving signal S6 may be supplied from the same voltage terminal via the same wire, thereby saving wiring ports and facilitating circuit wiring.

Figure 3:
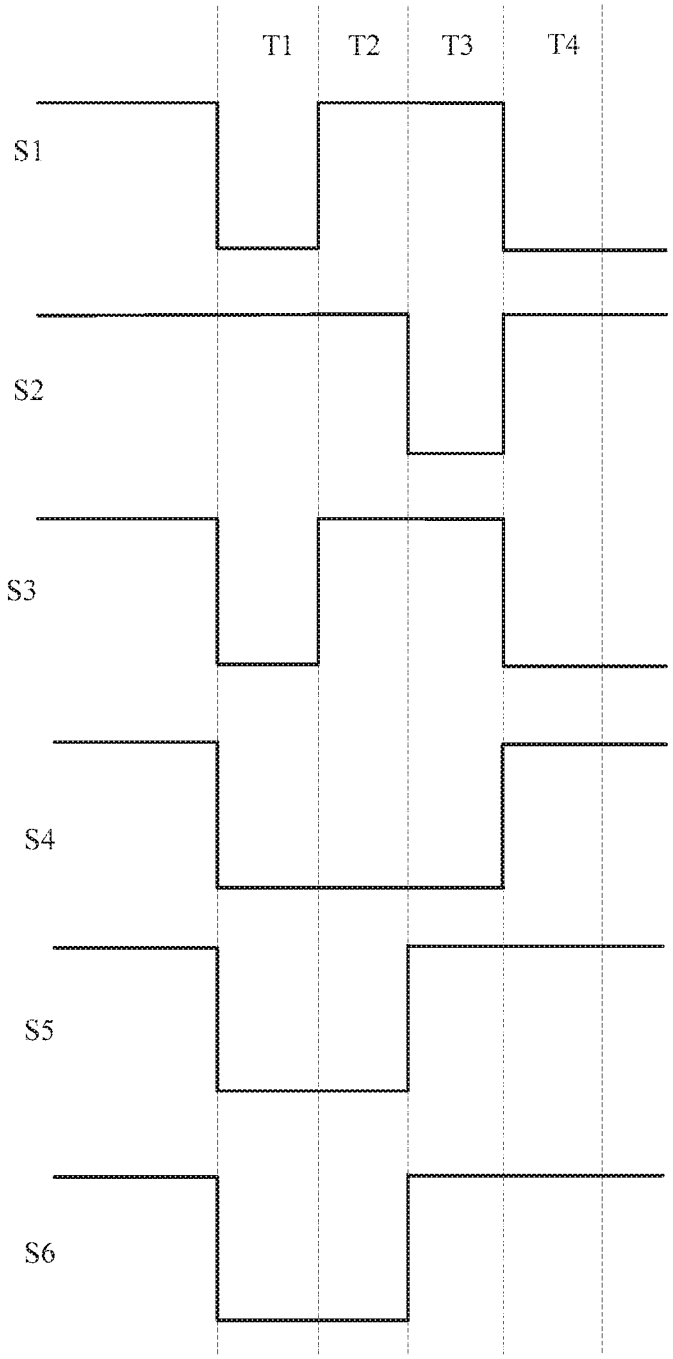
FIG. 3 is a diagram showing time sequences of driving signals of the pixel circuit shown in FIG. 2.

The driving process of the pixel circuit shown in FIG. 2 of the present disclosure is described in detail hereinafter. Reference is made to FIG. 3, which is a diagram showing time sequences of the driving signals of the pixel circuit shown in FIG. 2. Description is made by taking a case that the transistors in the embodiment of the present disclosure are P-type transistors as an example, and the fifth driving signal S5 and the sixth driving signal S6 are supplied from the same voltage terminal via the same wire.

Figure 4:
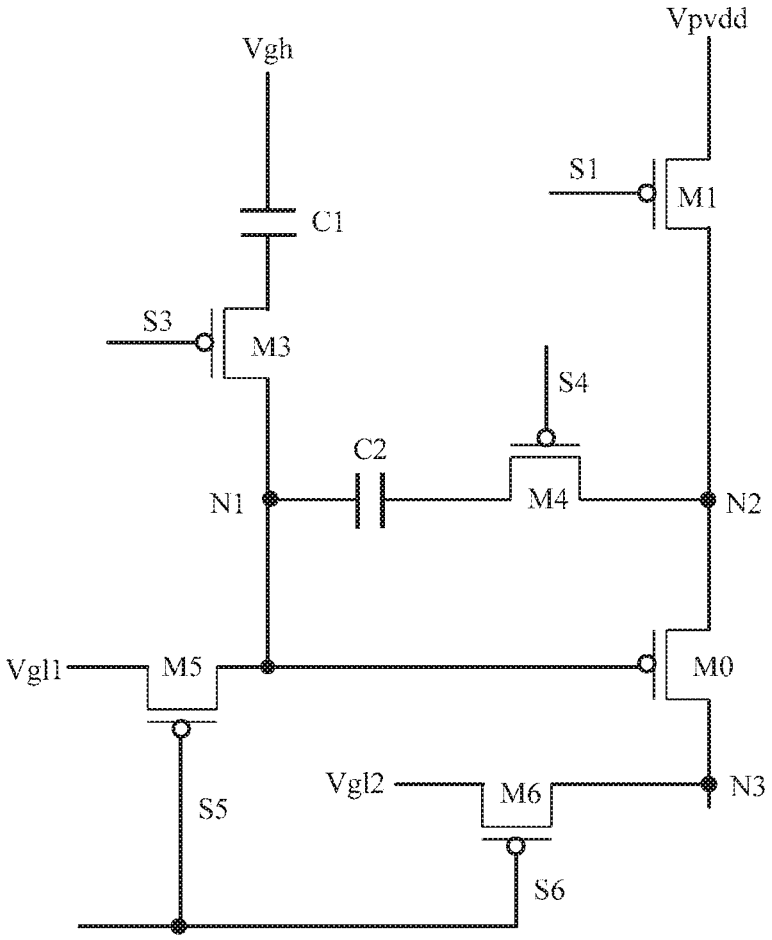
FIG. 4 is a schematic diagram of a current path in a phase T1 shown in FIG. 3.
Figure 5:
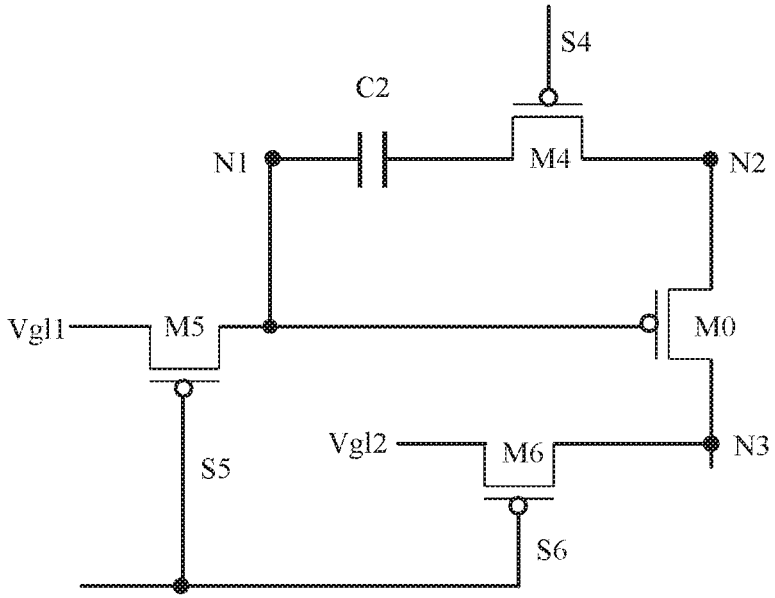
FIG. 5 is a schematic diagram of a current path in a phase T2 shown in FIG. 3.
Figure 6:
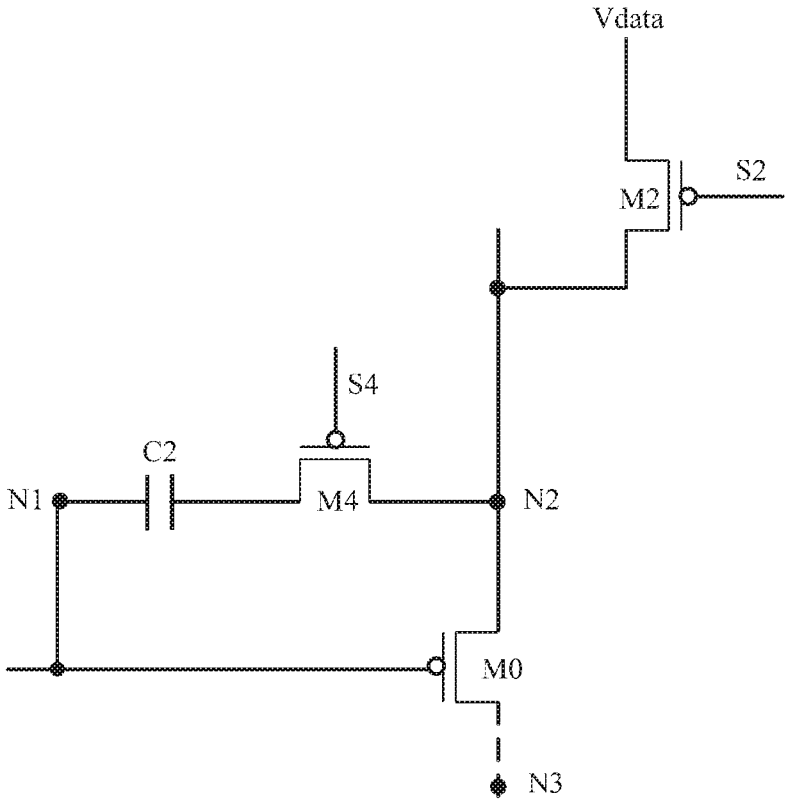
FIG. 6 is a schematic diagram of a current path in a phase T3 shown in FIG. 3.
Figure 7:
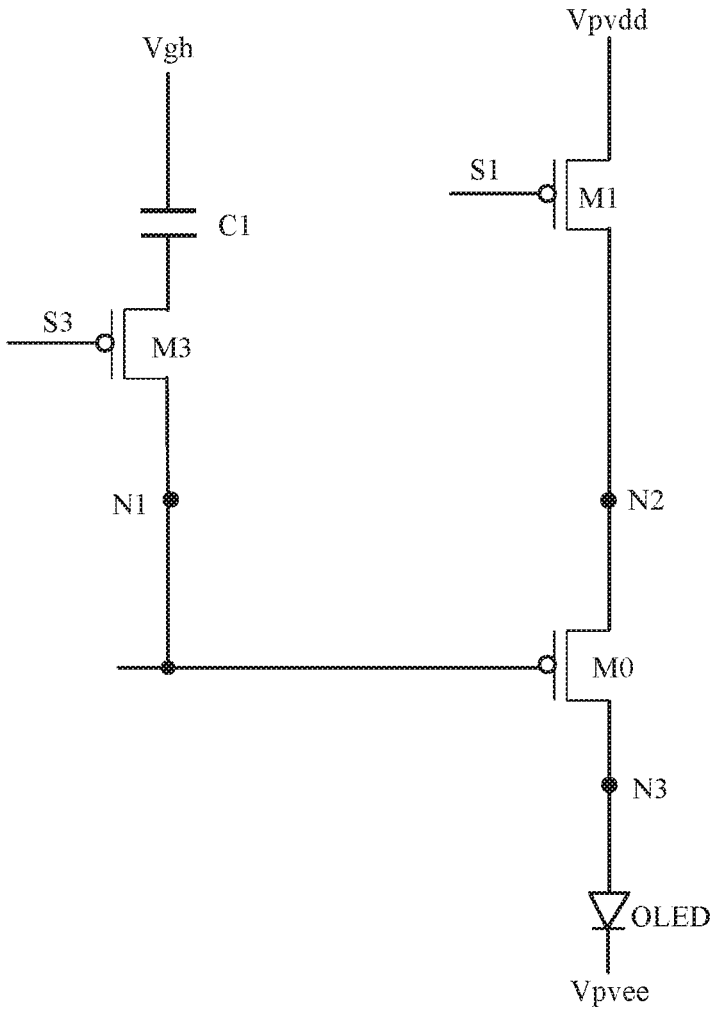
FIG. 7 is a schematic diagram of a current path in a phase T4 shown in FIG. 3.

Referring to FIG. 3, according to the embodiment of the present disclosure, the driving process of the pixel circuit includes an initialization phase T1, a threshold grabbing phase T2, a data writing phase T3 and a light emitting phase T4. FIG. 4 is a schematic diagram of a current path in the phase T1 shown in FIG. 3. FIG. 5 is a schematic diagram of a current path in the phase T2 shown in FIG. 3. FIG. 6 is a schematic diagram of a current path in the phase T3 shown in FIG. 3. FIG. 7 is a schematic diagram of a current path in the phase T4 shown in FIG. 3.

In the initialization phase T1, the first transistor M1, the third transistor M3, the fourth transistor M4, the fifth transistor M5 and the sixth transistor M6 are driven to be turned on, and the second transistor M2 is driven to be turned off, to drive the driving transistor M0 to be turned on.

As shown in FIG. 3 and FIG. 4, in the initialization phase T1, the first driving signal S1, the third driving signal S3, the fourth driving signal S4, the fifth driving signal S5 and the sixth driving signal S6 have low levels, to respectively control the first transistor M1, the third transistor M3, the fourth transistor M4, the fifth transistor M5 and the sixth transistor M6 to be turned on. The second driving signal S2 has a high level, to control the second transistor M2 to be turned off.

In the initialization phase T1, a voltage at a first node N1 (that is, a node at which the second electrode of the third transistor M3, the second electrode of the fifth transistor M5, the second plate of the second capacitor C2 and the gate of the driving transistor M0 are connected with each other) is the first low level voltage Vgl1, and a voltage at a second node N2 (that is, a node at which the second electrode of the first transistor M1, the second electrode of the second transistor M2, the first electrode of the fourth transistor M4 and the source of the driving transistor M0 are connected with each other) is the anode voltage Vpvdd, such that the driving transistor M0 is controlled to be turned on under the control of the first low level voltage Vgh1. Since a voltage at a third node N3 (that is, a node at which the drain of the driving transistor M0, the second electrode of the sixth transistor M6 and the anode of the light emitting element OLED are connected with each other) is the second low level voltage Vgl2, after the driving transistor M0 is turned on, the current of the driving transistor M0 is transmitted to the second low level voltage Vgh2 through the third node N3, such that the light emitting element OLED does not emit light. In this case, the gate, the source and the drain of the driving transistor M0 and the anode of the light emitting element OLED are all reset, thereby avoiding from grabbing a different threshold voltage after a gray scale transition, thus avoiding afterimages and insufficient brightness of the first frame after the gray scale transition.

According to the embodiment of the present disclosure, the first low level voltage Vgl1 may be the same as the second low level voltage Vgl2. For the above, the first low level voltage Vgl1 and the second low level voltage Vgl2 may be supplied from the same voltage terminal via the same wire, to save wires. For convenience of description, description is made in assuming that the first low level voltage Vgl1 is the same as the second low level voltage Vgl2, that is, both the first low level voltage Vgl1 and the second low level voltage Vgl2 equal to the low level voltage Vgl.

In the threshold grabbing phase T2, the fourth transistor M4, the fifth transistor M5 and the sixth transistor M6 are driven to be turned on, the first transistor M1, the second transistor M2 and the third transistor M3 are driven to be turned off, and the driving transistor M0 remains in the on state.

As shown in FIG. 3 and FIG. 5, in the threshold grabbing phase T2, the fourth driving signal S4, the fifth driving signal S5 and the sixth driving signal S6 have low levels, to respectively control the fourth transistors M4, the fifth transistor M5 and the sixth transistor M6 to be turned on. The first driving signal S1, the second driving signal S2 and the third driving signal S3 have high levels to respectively control the first transistor M1, the second transistor M2 and the third transistor M3 to be turned off.

In the threshold grabbing phase T2, the voltage at the first node N1 and the voltage at the third node N3 are low level voltages, and a potential at the second node N2 is pulled down by the driving transistor M0 which is in the on state. The driving transistor M0 is turned off when the potential of the second node N2 is decreased to be the sum of the low level voltage Vgl and the threshold voltage Vth of the driving transistor M0. In this case, the voltage at the second node N2 is expressed by Vgl+|Vth|. Moreover, in the threshold grabbing phase T2, the threshold voltage of the driving transistor M0 is compensated in the source following manner, thereby avoiding the hysteresis effect. That is, the source voltage of the driving transistor M0 changes as the change of the gate voltage, and the driving transistor M0 is turned off when the difference between the gate voltage and the source voltage of the driving transistor M0 equals to the threshold voltage Vth.

In the data writing phase T3, the second transistor M2 and the fourth transistor M4 are driven to be turned on, and the first transistor M1, the third transistor M3, the fifth transistor M5 and the sixth transistor M6 are driven to be turned off, to drive the driving transistor M0 to be turned off.

As shown in FIG. 3 and FIG. 6, in the data writing phase T3, the second driving signal S2 and the fourth driving signal S4 have low levels, to respectively control the second transistor M2 and the fourth transistor M4 to be turned on.

The first driving signal S1, the third driving signal S3, the fifth driving signal S5 and the sixth driving signal S6 have high levels, to respectively control the first transistor M1, third transistor M3, the fifth transistor M5 and the sixth transistor M6 to be turned off.

In the data writing phase T3, the voltage at the second node N2 is changed to be the data voltage Vdata. Since the second capacitor C2 performs voltage coupling after the second capacitor M2 is turned on, such that the voltage at the first node N1 is expressed by Vgl+Vdata−Vgl−|Vth|=Vdata−|Vth|. In this case, the data voltage is written to the gate of the driving transistor M0.

In the light emitting phase T4, the first transistor M1 and the third transistor M3 are driven to be turned on, and the second transistor M2, the fourth transistor M4, the fifth transistor M5 and the sixth transistor M6 are driven to be turned off, to drive the driving transistor M0 to be turned on.

As shown in FIG. 3 and FIG. 7, in the light emitting phase T4, the first driving signal S1 and the third driving signal S3 have low levels, to respectively control the first transistor M1 and the third transistor M3 to be turned on. The second driving signal S2, the fourth driving signal S4, the fifth driving signal S5 and the sixth driving signal S6 have high levels, to respectively control the second transistor M2, the fourth transistor M4, the fifth transistor M5 and the sixth transistor M6 to be turned off.

In the light emitting phase T4, since the third transistor M3 is turned on, the voltage at the first node N1 remains in Vdata−|Vth| by the first capacitor C1, and the voltage at the second node N2 is the anode voltage Vpvdd, to turn on the driving transistor M0, such that the driving current is transmitted to the light emitting element OLED, to cause the light emitting element OLED to emit light. In this case, the difference between the gate voltage and the source voltage of the driving transistor M0 is expressed by:

$$Vgs=Vpvdd-(V\text{data}-|Vth|)=Vpvdd-V\text{data}+|Vth| \quad \text{Equation 1}$$

Since the driving transistor M0 operates in a saturation region in the light emitting phase T3, the driving current Id for driving the light emitting element OLED to emit light is determined based on the difference between the gate voltage and the source voltage of the driving transistor M0. Therefore, the driving current Id is expressed by:

$$\begin{aligned} Id &= k(Vgs-|Vth|)^2 \quad \text{Equation 2} \\ &= k(Vpvdd-Vdata+|Vth|-|Vth|)^2 \\ &= k(Vpvdd-Vdata)^2 \end{aligned}$$

In Equation 2, Id represents the driving current generated by the drive transistor M0, that is, the current for driving the light emitting element to emit light, k represents a constant, and Vgs represents the difference between the gate voltage and the source voltage of the drive transistor M0.

Based on the above, a threshold voltage of the driving transistor is compensated through the cooperation of the transistors and the capacitors in the source following manner, such that the driving current generated by the driving transistor for driving a light emitting element to emit light is independent from the threshold voltage of the driving transistor itself, thereby compensating for a threshold drift caused by a process problem and eliminating uneven light emission of the display device, thus improving the uniformity of the light emission of the display device. In addition, the driving transistor and the anode of the light emitting element are reset through the cooperation of the transistors, thereby avoiding from grabbing a different threshold voltage after a gray scale transition, thus avoiding afterimages and insufficient brightness of the first frame after the gray scale transition.

Referring to FIG. 2, according to the embodiment of the present disclosure, the second low level voltage Vgl2 may be supplied from an independent voltage terminal. The second low level voltage Vgl2 and the first low level voltage Vgl1 may be supplied from the same voltage terminal in a case that the second low level voltage Vgl2 is the same as the first low level voltage Vgl1.

Figure 8:
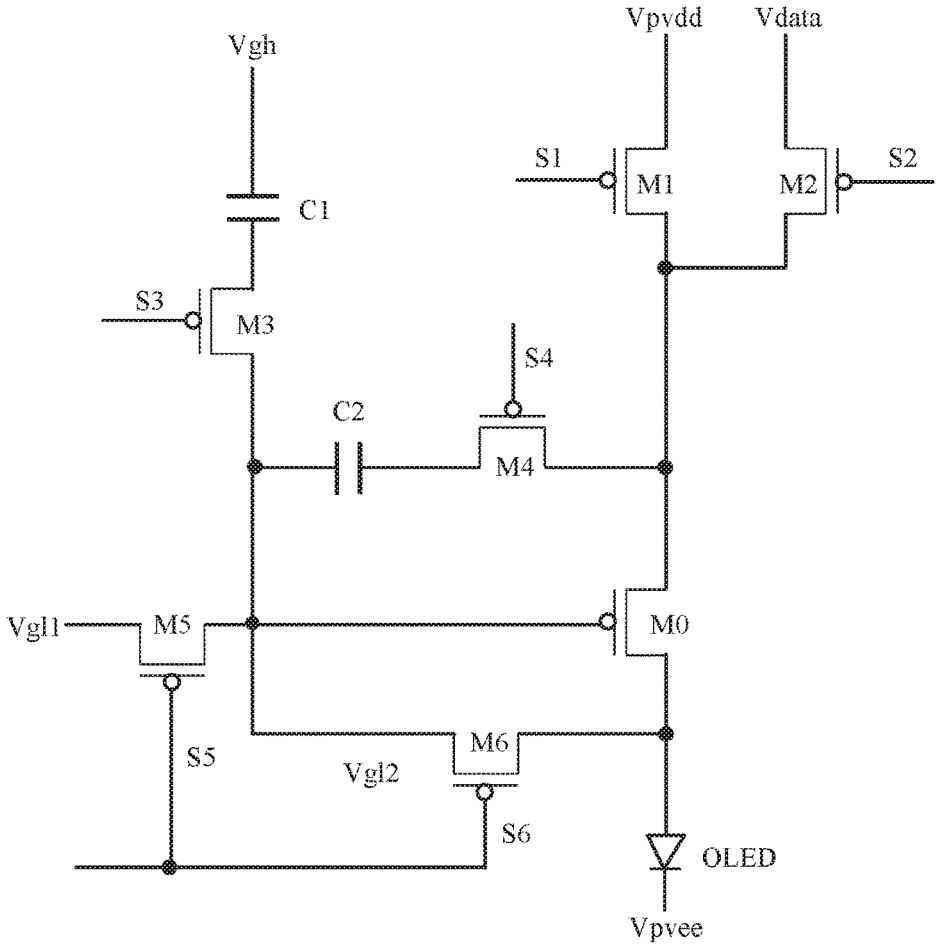
FIG. 8 is a schematic structural diagram of another pixel circuit according to Embodiment 1 of the present disclosure.

In another embodiment, reference is made to FIG. 8, which is a schematic structural diagram of another pixel circuit according to Embodiment 1 of the present disclosure. In order to facilitate wiring and reduce wiring ports, in the embodiment of the present disclosure, the second low level voltage Vgl2 is supplied to a terminal at which the second electrode of the fifth transistor M5, the second plate of the second capacitor C2 and the gate of the driving transistor M0 are connected with each other.

The pixel circuit shown in FIG. 8 has the same driving process as the driving process of the pixel circuit shown in FIG. 2, except that in the initialization phase T1 and the threshold grabbing phase T2, the current of the driving transistor M0 is transmitted to the first node N1 through the third node.

Embodiment 2

Figure 9:
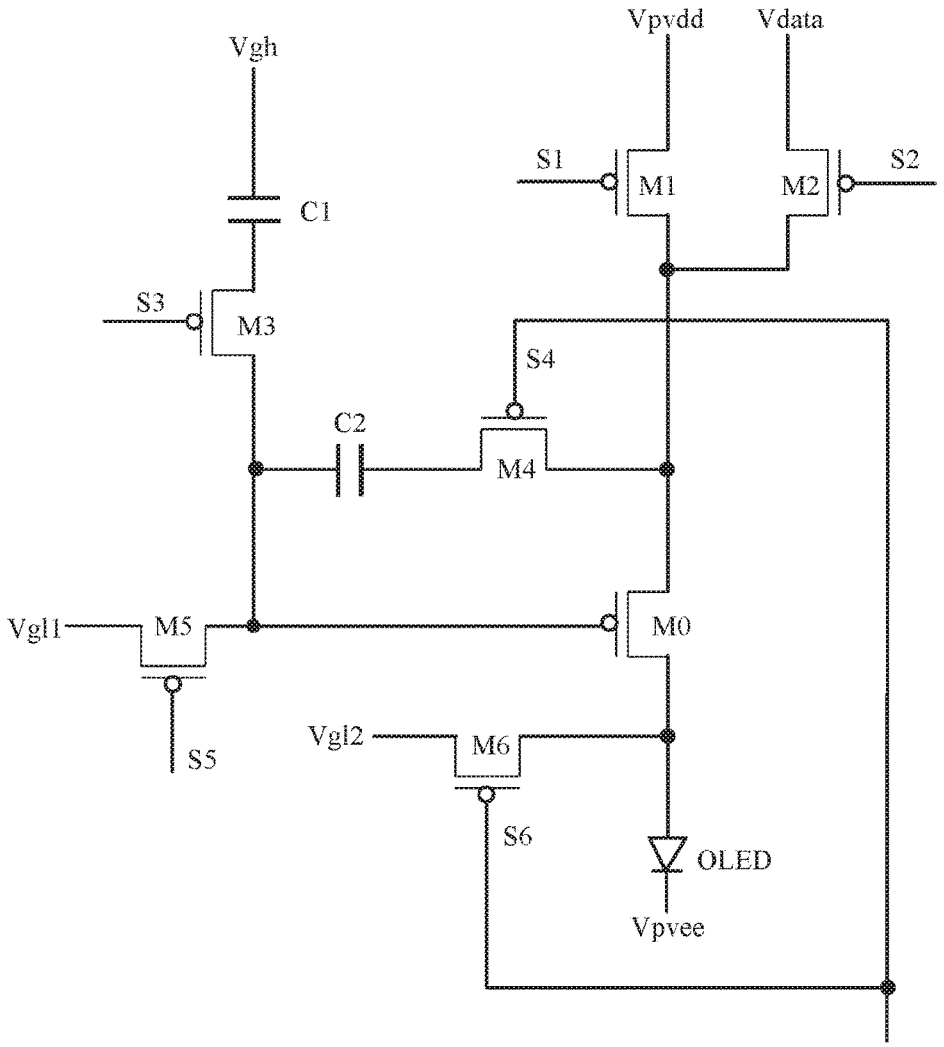
FIG. 9 is a schematic structural diagram of a pixel circuit according to Embodiment 2 of the present disclosure.
Figure 10:
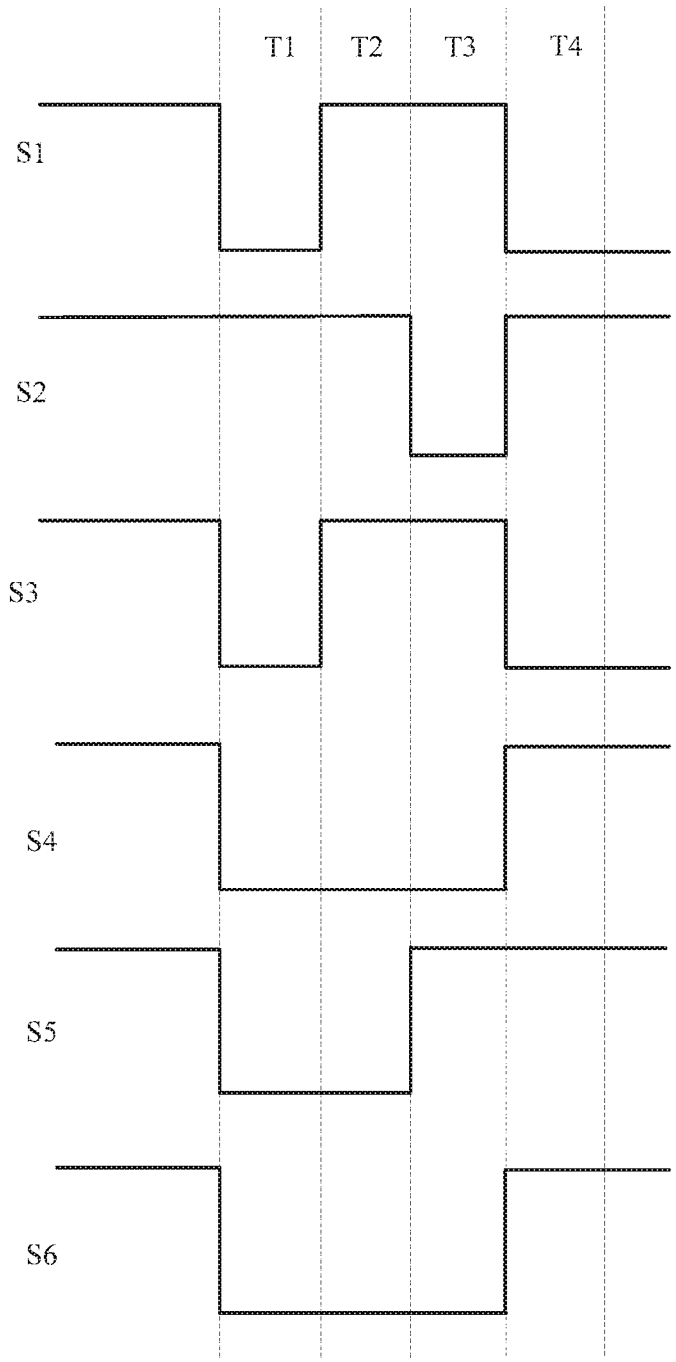
FIG. 10 is a diagram showing time sequences of driving signals of the pixel circuit shown in FIG. 9.

A pixel circuit according to Embodiment 2 of the present disclosure is described in detail in conjunction with FIG. 9 and FIG. 10. Reference is made to FIG. 9, which is a schematic structural diagram of a pixel circuit according to Embodiment 2 of the present disclosure. The pixel circuit is used to drive a light emitting element OLED, and the light emitting element OLED is a light emitting diode. The pixel circuit includes a first transistor M1, a second transistor M2, a third transistor M3, a fourth transistor M4, a fifth transistor M5, a sixth transistor M6, a driving transistor M0, a first capacitor C and a second capacitor C2.

A gate of the first transistor M1 is supplied with a first driving signal S1, a first electrode of the first transistor M1 is supplied with an anode voltage Vpvdd, and a second electrode of the first transistor M1 is connected to a source of the driving transistor M0.

A gate of the second transistor M2 is supplied with a second driving signal S2, a first electrode of the second transistor M2 is supplied with a data voltage Vdata, and a second electrode of the second transistor M2 is connected to the source of the driving transistor M0.

A gate of the third transistor M3 is supplied with a third driving signal S3, a first electrode of the third transistor M3 is connected to a second plate of the first capacitor C1, a second electrode of the third transistor M3 is connected to a second plate of the second capacitor C2 and a gate of the driving transistor M0, and a first plate of the first capacitor C1 is supplied with a high level voltage Vgh.

A gate of the fourth transistor M4 is supplied with a fourth driving signal S4, a first electrode of the fourth transistor M4 is connected to the source of the driving transistor M0, and a second electrode of the fourth transistor M4 is connected to a first plate of the second capacitor C2.

A gate of the fifth transistor M5 is supplied with a fifth driving signal S5, a first electrode of the fifth transistor M5 is supplied with a first low level voltage Vgl1, and a second electrode of the fifth transistor M5 is connected to the second plate of the second capacitor C2 and the gate of the driving transistor M0.

A gate of the sixth transistor M6 is supplied with a sixth driving signal S6, a first electrode of the sixth transistor M6 is supplied with a second low level voltage Vgl2, and a second electrode of the sixth transistor M6 is connected to a drain of the driving transistor M0 and an anode of the light emitting element OLED, and a cathode of the light emitting element is supplied with a cathode voltage Vpvee.

According to the embodiment of the present disclosure, the first capacitor C1 is mainly used for voltage maintaining after the third transistor M3 is turned on. The second capacitor C2 is mainly used for voltage coupling after the fourth transistor M4 is turned on. The first capacitor C and the second capacitor C2 are connected with each other in parallel and are independent from each other, such that the pixel circuit operates more stably.

According to the embodiment of the present disclosure, it is required to simultaneously turn on or simultaneously turn off the first transistor M1 and the third transistor M3 during the driving process of the pixel circuit. Therefore, in the embodiment of the present disclosure, an effective level of the first driving signal S1 and an effective level of the third driving signal S3 have the same time sequence. The effective level refers to a level for controlling a transistor to be turned on. By setting the effective level of the first driving signal S1 and the effective level of the third driving signal S3 to have the same time sequence, it is possible to control the first transistor M1 and third transistor M3 to be simultaneously turned on, and it is also possible to control the first transistor M1 and the third transistor M3 to be simultaneously turned off in a case of an ineffective level, to achieve the driving requirement that it is required to simultaneously turn on or simultaneously turn off the first transistor M1 and the third transistor M3 during the driving process of the pixel circuit.

According to the embodiment of the present disclosure, the first transistor M1 and the third transistor M3 may have the same turned-on condition or different turned-on conditions. In the embodiment of the present disclosure, in a case that the first transistor M1 and the third transistor M3 have the same turned-on condition, the first driving signal S1 is the same as the third driving signal S3. The first driving signal S and the third driving signal S3 may be supplied from different voltage terminals via different wires. In one embodiment, the first driving signal S and third driving signal S3 may be supplied from the same voltage terminal via the same wire, thereby saving wiring ports and facilitating circuit wiring.

According to the embodiment of the present disclosure, the fourth transistor M4 and the sixth transistor M6 may also be configured to be simultaneously turned on or simultaneously turned off during the driving process of the pixel circuit. Therefore, in the embodiment of the present disclosure, an effective level of the fourth driving signal S4 and an effective level of the sixth driving signal S6 have the same time sequence. The effective level refers to a level for controlling a transistor to be turned on. By setting the effective level of the fourth driving signal S4 and the effective level of the sixth driving signal S6 to have the same time sequence, it is possible to control the fourth transistor M4 and the sixth transistor M6 to be simultaneously turned on, and it is also possible to control the fourth transistor M4 and the sixth transistor M6 to be simultaneously turned off in a case of an ineffective level, to achieve the driving requirement that it is required to simultaneously turn on or simultaneously turn off the fourth transistor M4 and the sixth transistor M6 during the driving process of the pixel circuit.

According to the embodiment of the present disclosure, the fourth transistor M4 and the sixth transistor M6 may have the same turned-on condition or different turned-on conditions. In the embodiment of the present disclosure, in a case that the fourth transistor M4 and the sixth transistor M6 have the same turned-on condition, the fourth driving signal S4 is the same as the sixth driving signal S6. The fourth driving signal S4 and the sixth driving signal S6 may be supplied from different voltage terminals via different wires. In one embodiment, the fourth driving signal S4 and the sixth driving signal S6 may be supplied from the same voltage terminal via the same wire, thereby saving wiring ports and facilitating circuit wiring.

The driving process of the pixel circuit shown in FIG. 9 of the present disclosure is described in detail hereinafter. Reference is made to FIG. 10, which is a diagram showing time sequences of the driving signals of the pixel circuit shown in FIG. 9. Description is made by taking a case that the transistors in the embodiment of the present disclosure are P-type transistors as an example, and the fourth driving signal S4 and the sixth driving signal S6 are supplied from the same voltage terminal via the same wire. In the embodiment of the present disclosure, the second low level voltage Vgl2 may be supplied from an independent voltage terminal. The second low level voltage Vgl2 and the first low level voltage Vgl1 may be supplied from the same voltage terminal in a case that the second low level voltage Vgl2 is the same as the first low level voltage Vgl1.

Referring to FIG. 10, according to the embodiment of the present disclosure, the driving process of the pixel circuit includes an initialization phase T1, a threshold grabbing phase T2, a data writing phase T3 and a light emitting phase T4.

In the initialization phase T1, the first transistor M1, the third transistor M3, the fourth transistor M4, the fifth transistor M5 and the sixth transistor M6 are driven to be turned on, and the second transistor M2 is driven to be turned off, to drive the driving transistor M0 to be turned on.

In the threshold grabbing phase T2, the fourth transistor M4, the fifth transistor M5 and the sixth transistor M6 are driven to be turned on, the first transistor M1, the second transistor M2 and the third transistor M3 are driven to be turned off, and the driving transistor M0 remains in the on state.

In the data writing phase T3, the second transistor M2, the fourth transistor M4 and the sixth transistor M6 are driven to be turned on, and the first transistor M1, the third transistor M3 and the fifth transistor M5 are driven to be turned off, to drive the driving transistor M0 to be turned off.

In the light emitting phase T4, the first transistor M1 and the third transistor M3 are driven to be turned on, and the second transistor M2, the fourth transistor M4, the fifth transistor M5 and the sixth transistor M6 are driven to be turned off, to drive the driving transistor M0 to be turned on.

It is to be noted that the four phases of the driving process of the pixel circuit according to Embodiment 2 of the present disclosure are substantially the same as the four phases of the driving process of the pixel circuit according to Embodiment 1 of the present disclosure. Therefore, the above driving process is not repeated in Embodiment 2 of the present disclosure. The difference between the driving process of the pixel circuit according to Embodiment 2 of the present disclosure and the driving process of the pixel circuit according to Embodiment 1 of the present disclosure lies in the driving manner of the sixth transistor M6. In Embodiment 2 of the present disclosure, the sixth transistor M6 is controlled as follows: the sixth transistor M6 remains in the on state in the initialization phase T1, the threshold grabbing phase T2 and the data writing phase T3, such that the sixth transistor M6 remains in supplying the second low level voltage Vgl2 to the anode of the light emitting element OLED before the light emitting phase T4, making the light emitting element OLED be in a good dark state before the light emitting phase T4.

In any of the above embodiments of the present disclosure, the first transistor M1, the second transistor M2, the third transistor M3, the fourth transistor M4, the fifth transistor M5, the sixth transistor M6 and the driving transistor M0 are P-type transistors. In another embodiment, the first transistor, the second transistor, the third transistor, the fourth transistor, the fifth transistor and the sixth transistor are N-type transistors, and the driving transistor is a P-type transistor, which is not specifically limited in the present disclosure.

In any of the above embodiments of the present disclosure, the high level voltage Vgh and the anode voltage Vpvdd are supplied from the same voltage terminal, that is, the high level voltage Vgh is the same as the anode voltage Vpvdd.

Correspondingly, a display device is further provided according to an embodiment of the present disclosure, which includes the above-described pixel circuit.

A pixel circuit and a display device are provided according to the present disclosure. The pixel circuit includes a first transistor, a second transistor, a third transistor, a fourth transistor, a fifth transistor, a sixth transistor, a driving transistor, a first capacitor and a second capacitor. A threshold voltage of the driving transistor is compensated through the cooperation of the transistors and the capacitors in a source following manner, such that the driving current generated by the driving transistor for driving a light emitting element to emit light is independent from the threshold voltage of the driving transistor itself, thereby compensating for a threshold drift caused by a process problem and eliminating uneven light emission of the display device, thus improving the uniformity of the light emission of the display device. In addition, the driving transistor and the anode of the light emitting element are reset through the cooperation of the transistors, thereby avoiding from grabbing a different threshold voltage after a gray scale transition, thus avoiding afterimages and insufficient brightness of the first frame after the gray scale transition.

The invention claimed is:

1. A pixel circuit for driving a light emitting element, the pixel circuit comprising:

a first transistor, a second transistor, a third transistor, a fourth transistor, a fifth transistor, a sixth transistor, a driving transistor, a first capacitor and a second capacitor, wherein a gate of the first transistor is supplied with a first driving signal, a first electrode of the first transistor is supplied with an anode voltage, and a second electrode of the first transistor is connected to a source of the driving transistor;

a gate of the second transistor is supplied with a second driving signal, a first electrode of the second transistor is supplied with a data voltage, and a second electrode of the second transistor is connected to the source of the driving transistor;

a gate of the third transistor is supplied with a third driving signal, a first electrode of the third transistor is connected to a second plate of the first capacitor, a second electrode of the third transistor is connected to a second plate of the second capacitor and a gate of the driving transistor, and a first plate of the first capacitor is supplied with a high level voltage;

a gate of the fourth transistor is supplied with a fourth driving signal, a first electrode of the fourth transistor is connected to the source of the driving transistor, and a second electrode of the fourth transistor is connected to a first plate of the second capacitor;

a gate of the fifth transistor is supplied with a fifth driving signal, a first electrode of the fifth transistor is supplied with a first low level voltage, and a second electrode of the fifth transistor is connected to the second plate of the second capacitor and the gate of the driving transistor; and a gate of the sixth transistor is supplied with a sixth driving signal, a first electrode of the sixth transistor is supplied with a second low level voltage, a second electrode of the sixth transistor is connected to a drain of the driving transistor and an anode of the light emitting element, and a cathode of the light emitting element is supplied with a cathode voltage.

2. The pixel circuit according to claim 1, wherein an effective level of the first driving signal and an effective level of the third driving signal have a same time sequence.

3. The pixel circuit according to claim 1, wherein an effective level of the fifth driving signal and an effective level of the sixth driving signal have a same time sequence.

4. The pixel circuit according to claim 3, wherein a driving process of the pixel circuit comprises an initialization phase, a threshold grabbing phase, a data writing phase and a light emitting phase, and wherein in the initialization phase, the first transistor, the third transistor, the fourth transistor, the fifth transistor and the sixth transistor are driven to be turned on, and the second transistor is driven to be turned off, to drive the driving transistor to be turned on;

in the threshold grabbing phase, the fourth transistor, the fifth transistor and the sixth transistor are driven to be turned on, the first transistor, the second transistor and the third transistor are driven to be turned off, and the driving transistor remains in an on state;

in the data writing phase, the second transistor and the fourth transistor are driven to be turned on, the first transistor, the third transistor, the fifth transistor and the sixth transistor are driven to be turned off, to drive the driving transistor to be turned off; and in the light emitting phase, the first transistor and the third transistor are driven to be turned on, the second transistor, the fourth transistor, the fifth transistor and the sixth transistor are driven to be turned off, to drive the driving transistor to be turned on.

5. The pixel circuit according to claim 3, wherein the second low level voltage is supplied from an independent voltage terminal.

6. The pixel circuit according to claim 3, wherein the second low level voltage is supplied to a terminal at which the second electrode of the fifth transistor, the second plate of the second capacitor and the gate of the driving transistor are connected with each other.

7. The pixel circuit according to claim 1, wherein an effective level of the fourth driving signal and an effective level of the sixth driving signal have a same time sequence.

8. The pixel circuit according to claim 7, wherein a driving process of the pixel circuit comprises an initialization phase, a threshold grabbing phase, a data writing phase and a light emitting phase, and wherein in the initialization phase, the first transistor, the third transistor, the fourth transistor, the fifth transistor and the sixth transistor are driven to be turned on, and the second transistor is driven to be turned off, to drive the driving transistor to be turned on;

in the threshold grabbing phase, the fourth transistor, the fifth transistor and the sixth transistor are driven to be turned on, the first transistor, the second transistor and the third transistor are driven to be turned off, and the driving transistor remains in an on state;

in the data writing phase, the second transistor, the fourth transistor and the sixth transistor are driven to be turned on, the first transistor, the third transistor and the fifth transistor are driven to be turned off, to drive the driving transistor to be turned off; and in the light emitting phase, the first transistor and the third transistor are driven to be turned on, and the second transistor, the fourth transistor, the fifth transistor and the sixth transistor are driven to be turned off, to drive the driving transistor to be turned on.

9. The pixel circuit according to claim 1, wherein the first transistor, the second transistor, the third transistor, the fourth transistor, the fifth transistor, the sixth transistor and the driving transistor are P-type transistors.

10. The pixel circuit according to claim 1, wherein the high level voltage and the anode voltage are supplied from a same voltage terminal.

11. A display device comprising a pixel circuit, wherein the pixel circuit comprises:

a first transistor, a second transistor, a third transistor, a fourth transistor, a fifth transistor, a sixth transistor, a driving transistor, a first capacitor and a second capacitor, and wherein a gate of the first transistor is supplied with a first driving signal, a first electrode of the first transistor is supplied with an anode voltage, and a second electrode of the first transistor is connected to a source of the driving transistor;

a gate of the second transistor is supplied with a second driving signal, a first electrode of the second transistor is supplied with a data voltage, and a second electrode of the second transistor is connected to the source of the driving transistor;

a gate of the third transistor is supplied with a third driving signal, a first electrode of the third transistor is connected to a second plate of the first capacitor, a second electrode of the third transistor is connected to a second plate of the second capacitor and a gate of the driving transistor, and a first plate of the first capacitor is supplied with a high level voltage;

a gate of the fourth transistor is supplied with a fourth driving signal, a first electrode of the fourth transistor is connected to the source of the driving transistor, and a second electrode of the fourth transistor is connected to a first plate of the second capacitor;

a gate of the fifth transistor is supplied with a fifth driving signal, a first electrode of the fifth transistor is supplied with a first low level voltage, and a second electrode of the fifth transistor is connected to the second plate of the second capacitor and the gate of the driving transistor, and a gate of the sixth transistor is supplied with a sixth driving signal, a first electrode of the sixth transistor is supplied with a second low level voltage, a second electrode of the sixth transistor is connected to a drain of the driving transistor and an anode of the light emitting to element, and a cathode of the light emitting element is supplied with a cathode voltage.

* * * * *